US007735434B2

(12) United States Patent
Lonardi

(10) Patent No.: US 7,735,434 B2
(45) Date of Patent: Jun. 15, 2010

(54) MULTIPLE-HEARTH FURNACE

(75) Inventor: Emile Lonardi, Bascharage (LU)

(73) Assignee: Paul Wurth S.A., Luxembourg (LU)

( * ) Notice: Subject to any disclaimer, the term of this patent is extended or adjusted under 35 U.S.C. 154(b) by 366 days.

(21) Appl. No.: 11/570,031

(22) PCT Filed: Apr. 13, 2005

(86) PCT No.: PCT/EP2005/051628

§ 371 (c)(1),
(2), (4) Date: Mar. 1, 2007

(87) PCT Pub. No.: WO2005/119153

PCT Pub. Date: Dec. 15, 2005

(65) Prior Publication Data

US 2007/0209563 A1 Sep. 13, 2007

(30) Foreign Application Priority Data

Jun. 2, 2004 (LU) ..... 91080

(51) Int. Cl.
*F23B 10/00* (2006.01)

(52) U.S. Cl. ..... 110/225; 110/208; 110/228; 431/122; 126/155

(58) Field of Classification Search ..... 165/93, 165/DIG. 152, DIG. 146; 432/235, 124, 432/131, 233, 138, 139, 142, 208, 209, 225; 110/249, 247, 223, 225, 342, 341, 208, 228, 110/209, 295, 347, 173 R, 174, 175 R, 258, 110/165 R, 170, 222; 75/483, 484; 366/279, 366/292, 309, 305, 307; 122/387, 384; 431/32, 431/121, 122; 414/153; 126/173, 155
See application file for complete search history.

(56) References Cited

U.S. PATENT DOCUMENTS 2,317,941 A 4/1943 Rowen
2,471,882 A * 5/1949 Martin ..... 432/131

(Continued)

FOREIGN PATENT DOCUMENTS

GB 393 387 6/1933

(Continued)

OTHER PUBLICATIONS

English translation of Written Opinion of the International Searching Authority.

*Primary Examiner*—Kenneth B Rinehart
*Assistant Examiner*—David J Laux
(74) *Attorney, Agent, or Firm*—Woodard, Emhardt, Moriarty, McNett & Henry LLP

(57) ABSTRACT

The inventive multi-level furnace comprises a furnace wall delimiting a cylindrical space having a vertical axis, a plurality of beds defining the levels inside said cylindrical space and at least one scraping arm which is provided with a wall scraper and associated with the bed in such a way that it is rotatable about the vertical axis of the furnace. During scraping arm rotation, said wall scraper defines a scraped area on the internal surface of the furnace wall which comprises a plurality of wall cavities forming a row of access openings in the scraped area, thereby making it possible to avoid the formation of a hardened crust adhered to the internal surface of the furnace wall and to develop braking shocks in the scraping arm.

20 Claims, 5 Drawing Sheets

U.S. PATENT DOCUMENTS

| | | | | | |
|---|---|---|---|---|---|
| 2,488,115 | A | * | 11/1949 | Benos | 432/131 |
| 2,676,006 | A | * | 4/1954 | Martin | 432/138 |
| 2,969,960 | A | * | 1/1961 | Gurley, Jr. | 366/303 |
| 3,175,809 | A | * | 3/1965 | Grimes | 366/342 |
| 3,361,419 | A | * | 1/1968 | Siemssen | 431/123 |
| 3,430,928 | A | | 3/1969 | Smith | |
| 3,874,644 | A | * | 4/1975 | Grimes | 432/139 |
| 5,720,855 | A | * | 2/1998 | Baird | 202/248 |
| 5,752,452 | A | * | 5/1998 | Leger | 110/346 |
| 6,832,564 | B2 | * | 12/2004 | Hutmacher et al. | 110/341 |

FOREIGN PATENT DOCUMENTS

| | | |
|---|---|---|
| GB | 1272378 | 4/1972 |
| RU | 2100701 | 12/1997 |
| WO | WO 96/10718 | 4/1996 |
| WO | WO 03002925 | 1/2003 |

* cited by examiner

MULTIPLE-HEARTH FURNACE

FIELD OF THE INVENTION

The present invention concerns a multiple-hearth furnace.

BACKGROUND OF THE INVENTION

A multiple-hearth furnace comprises a furnace wall delimiting a cylindrical space with a vertical axis. A plurality of soles positioned one above the other delimit the hearths of the furnace within this space. In each hearth, rabble arms rotated by means of a central shaft coaxial with the vertical axis of the furnace are provided. These rabble arms are equipped with sole scrapers which turn over the material under treatment on the sole and displace it on a first type of sole toward the periphery and on a second type of sole toward the center of the sole. The first type of sole is provided with peripheral drop holes through which the material under treatment falls onto a sole of the second type in the stage below. The second type of sole is provided with a central drop hole through which the material under treatment falls onto a sole of the first type in the stage below.

It is also a known practice to equip at least one rabble arm in each stage of the furnace with a wall scraper. The function of this wall scraper is to recover the material that accumulates in the immediate vicinity of the furnace wall so as to push it into the peripheral drop holes on the first type of sole and, on the second type of sole, to redirect it into the flow of material being displaced toward the center of the furnace. When the furnace starts, there is a radial clearance between the wall scraper and the inner surface of the furnace wall. However, as the furnace operates, this functional clearance is quickly clogged with material under treatment. A layer of material forms on the inner surface of the wall which the wall scraper progressively compacts by a "pasting" process, eventually forming a very hard crust that adheres to the inner surface of the wall. The wall scraper rubs against this peripheral crust, generating a by no means insignificant additional braking moment on the rabble arm. It should be noted that the situation is aggravated by the fact that hardness and resistance of the peripheral crust are not usually uniform. The modulus of the braking force exerted on the wall scraper thus varies irregularly, causing jerking of the rabble arm. This results in dynamic stresses which generate fatigue effects that are the source of numerous rabble arm fractures.

The object of the present invention is to propose a multiple-hearth furnace which reduces the abovementioned effects. According to the invention, this objective is achieved by a multiple-hearth furnace according to Claim 1.

BRIEF SUMMARY OF THE INVENTION

A multiple-hearth furnace according to the present invention comprises, in a manner that is known per se, a furnace wall delimiting a cylindrical space with a vertical axis, a plurality of soles which delimit the hearths within this cylindrical space and at least one rabble arm with a wall scraper. This wall scraper is associated with one of the soles, where it is rotated about the vertical axis of the furnace. During the rotation of this rabble arm about its vertical axis, its wall scraper defines a scraped zone on the inner surface of the furnace wall. According to the present invention, the furnace wall comprises a plurality of wall cavities which form a succession of access openings into the zone scraped by the wall scraper. It will be appreciated that these wall cavities greatly reduce the risk of formation of a crust of hardened material adhering to the inner surface of the furnace wall. Through these access openings in the scraped zone, the wall cavities become filled with material, but a "pasting" compaction effect, which is the origin of the formation of a hardened crust adhering to the inner surface of the furnace wall, scarcely occurs. The material that accumulates in the wall cavities remains relatively soft and results in substantially jerk-free braking.

The furnace wall generally comprises an external shell and a refractory inner liner. The wall cavities mentioned above are made in the refractory liner, and in a preferred embodiment, the shell is equipped with cleaning openings through which the wall cavities are accessible. It is thus easy to obtain access to the wall cavities in order to push back the material that has accumulated in the wall cavities onto the sole. It is even possible to clean the sole through these cleaning openings over a certain radial depth which depends on the tools employed. With tools having their ends bent back by a certain angle, it is also possible to clean the inner surface of the refractory liner through the cleaning openings.

For reasons of stability, leak-tightness and thermal insulation of the furnace wall, the cleaning opening associated with a wall cavity will be substantially smaller in cross section than the access opening formed by the wall cavity in the scraped zone. For the same reasons, the cross section of the wall cavity preferably diminishes progressively in the direction of the cleaning opening.

Preferably, the circumferential extent of the residual surface between two successive access openings is smaller than the circumferential extent of such an access opening. Ideally, two successive access openings would be separated by a sharp edge, but for reasons of wear and stability, a residual surface will generally be provided between two access openings. The circumferential extent of this residual surface is preferably smaller than 50% of the circumferential extent of one of the access openings that it separates. In the vertical direction, the access openings extend slightly beyond the upper limit of the scraped zone.

The wall cavities can easily be cleaned through the cleaning openings in the external shell by workers equipped with special tools. However, it is also possible to envisage equipping one or more or even all the wall cavities with a fluid injection device so as to be able to eject the material accumulated in the wall cavity onto the sole by means of the liquid injected. Alternatively, one or more or even all of the wall cavities can be equipped with a mechanical pusher, so as to be able to push the material accumulated in a wall cavity onto the sole.

Each of the cleaning openings can also advantageously have associated with it a plugging device comprising a steel blind flange fixed to a companion flange of the external shell mentioned above and a central core made of refractory material that penetrates into the cleaning opening.

BRIEF DESCRIPTION OF THE SEVERAL VIEWS OF THE DRAWINGS

Further specific features and features of the invention will become apparent from the detailed description of some advantageous embodiments which are described below, by way of illustration, with reference to the attached drawings. These show the following.

DETAILED DESCRIPTION OF THE INVENTION

Figure 1:
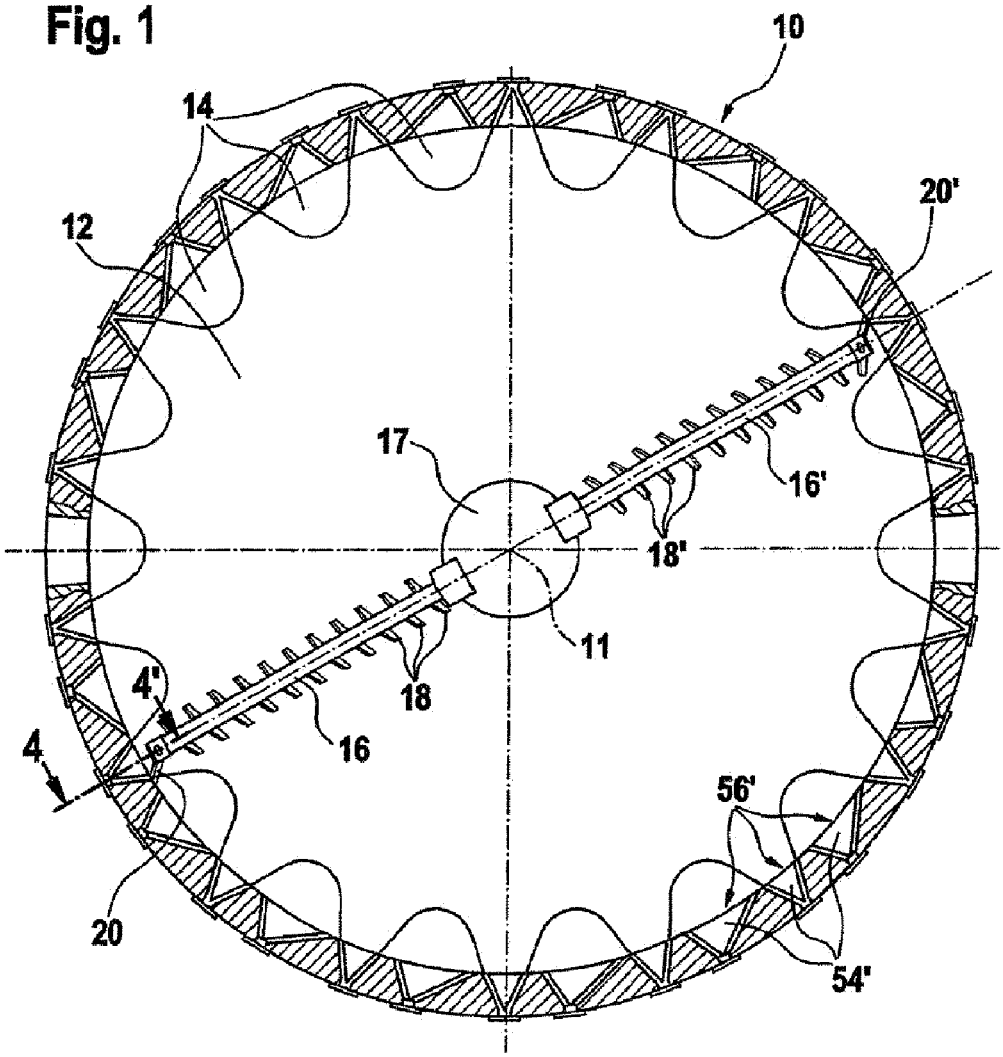
FIG. 1: A cross section through a multiple-hearth furnace at the level of a first type of sole.

FIG. 1 shows a first cross section through a multiple-hearth furnace according to the invention. A furnace wall 10 radially delimits a cylindrical space with a vertical axis 11 (perpendicular to the plane of the drawing). Inside this space, a plurality of soles positioned one above the other delimit the stages of the furnace in the vertical direction. FIG. 1 shows a first type of sole 12. This is a sole 12 with peripheral drop holes 14. Associated with this sole 12 are two rabble arms 16, 16' which are driven in rotation about the vertical axis 11 by a drive shaft 17. Each of the rabble arms 16, 16' carries a series of sole scrapers 18, 18' oriented so that they turn over the material under treatment on the sole 12 and displace it toward the periphery of the sole 12, where it falls through the peripheral drop holes 14 onto a peripheral surface of a lower sole. The references 20, 20' denote wall scrapers, whose function is to recover the material accumulating in the immediate proximity of the furnace wall 10 and push it into the peripheral drop holes 14.

Figure 2:
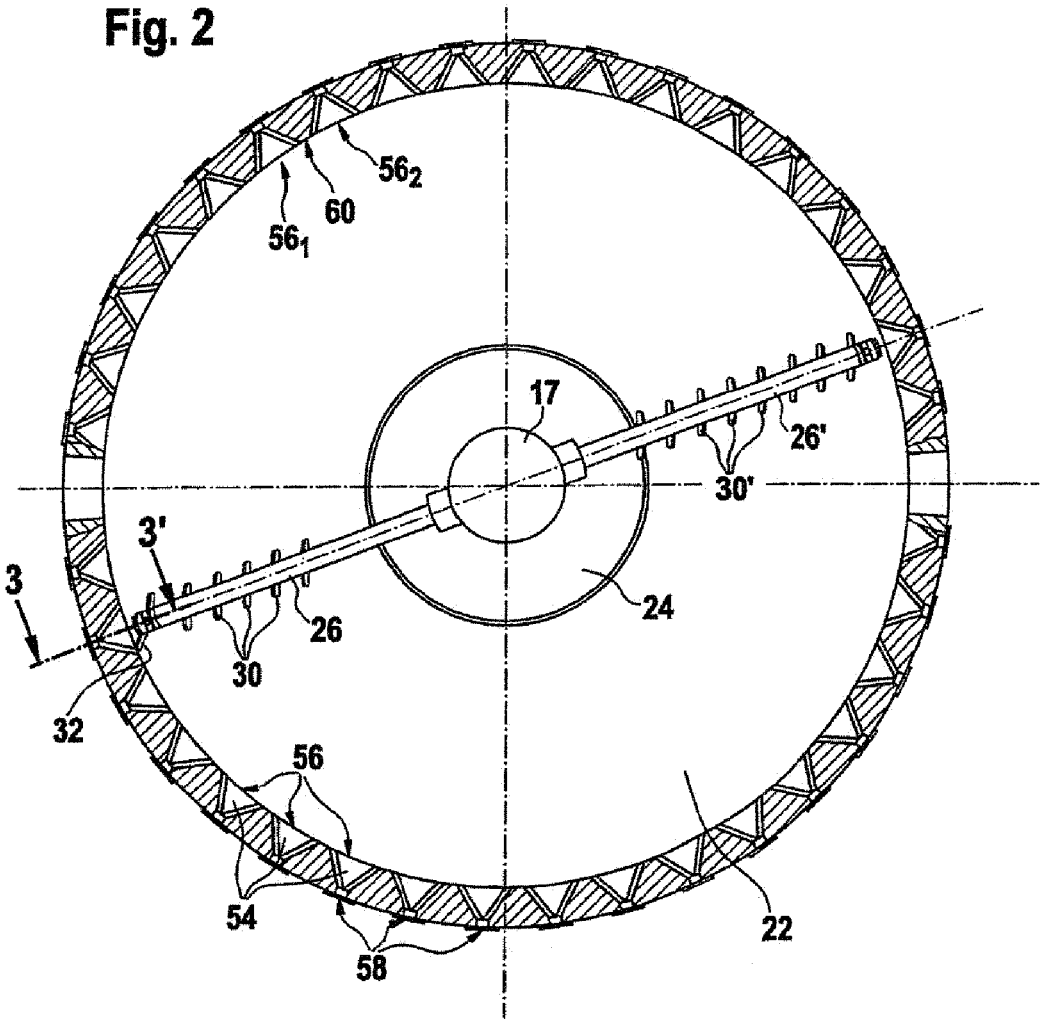
FIG. 2: A cross section through a multiple-hearth furnace at the level of a second type of sole.

FIG. 2 shows a second type of sole 22. This is a sole 22 with a central drop hole 24 surrounding the drive shaft 17. Associated with this sole 22 are two rabble arms 26, 26' which are similarly rotated by the drive shaft 17. Each of the rabble arms 26, 26' carries a series of sole scrapers 30, 30', this time oriented so that they turn over the material under treatment on the sole 22 and displace it toward the central region of the sole 22, where it falls through the central drop hole 24 into the central region of a lower sole. The reference 32 denotes a wall scraper 26 whose purpose is to recover the material accumulating in the immediate proximity of the furnace wall 10 and push it into the flow of material being displaced toward the center of the sole 22.

The soles of the multiple-hearth furnace are alternately of the first type shown in FIG. 1 and of the second type shown in FIG. 2. The material under treatment that falls into the central region of a sole 12 of the first type is displaced by the rabble arms 16, 16' into the peripheral region of this sole 12, where it falls through the peripheral drop holes 14 onto the peripheral region of a sole 22 of the second type. Here, the material under treatment is taken up by the rabble arms 26, 26' of this sole 22. These rabble arms 26, 26' displace the material under treatment into the central region of the sole 22, where it falls through the central drop hole 24 onto another sole of the first type shown in FIG. 1.

Figure 3:
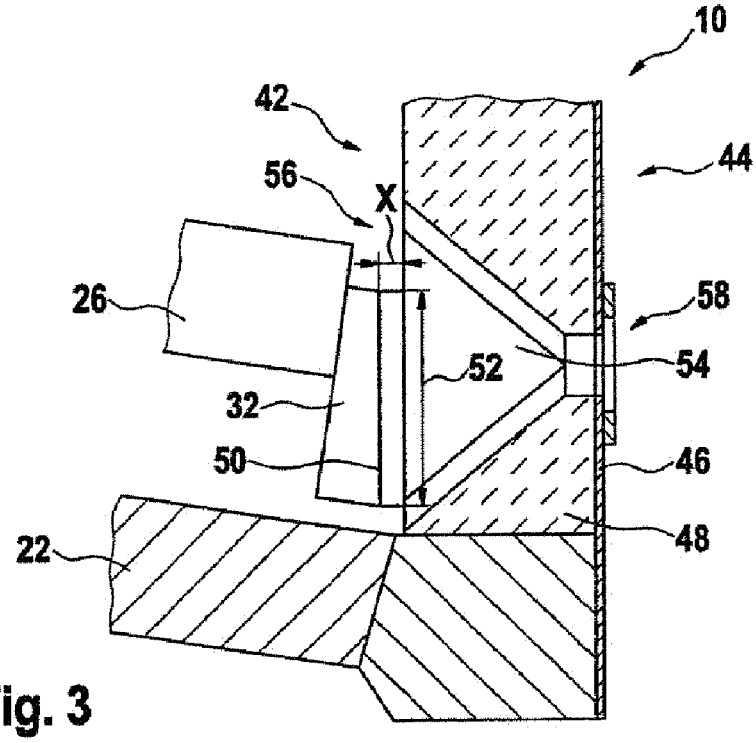
FIG. 3: A vertical cross section along the line 3-3' shown in FIG. 2.

FIG. 3 shows a vertical cross section through the furnace wall 10 at the level of the sole 22 in FIG. 2, the reference 42 identifying the inner surface and the reference 44 the outer surface of the furnace wall 10. This furnace wall 10 comprises, in a manner known per se, an external shell 46 made of steel and a refractory inner liner 48. FIG. 3 also shows the end of the wall scraper 26 with its wall scraper 32, displaying a terminal blade 50. As the wall scraper 26 rotates about the vertical axis 11, the terminal blade 50 passes at a distance "x" from the inner surface 42 of the furnace wall 10. This distance "x" must be calculated so as to avoid any direct contact between the wall scraper 32 and the refractory inner liner 48, even when the wall scraper 26 and the furnace wall 10 undergo thermal expansions or contractions of different amplitudes. If a projection is made of the two ends of the terminal blade 50 rotating about the vertical axis 11 onto the inner surface 42 of the furnace wall 10, two circles are defined on this surface 42 delimiting an annular zone 52 which represents the scraped zone 52 of the furnace wall 10 at the level of the sole 22.

According to the present invention, the furnace wall 10 comprises a plurality of wall cavities 54 which form a succession of access openings 56 in the scraped zone 52. It will be appreciated that these wall cavities 54, which are formed in the refractory inner liner 48, greatly reduce the risk of formation of a crust of hardened material adhering to the inner surface 42 of the furnace wall 10 and offering resistance to the passage of the wall scraper 32. Through these access openings 56 in the scraped zone 52, the wall cavities 54 in the wall 10 become progressively filled with material. However, the "pasting" compaction effect, which is the origin of the formation of a peripheral crust of very hard material adhering to the inner surface of the furnace wall, scarcely occurs. The material that accumulates in the wall cavities 54 is scarcely compacted by the passage of the wall scraper 32. It remains relatively soft and thus results in substantially jerk-free braking.

Cleaning openings 58 in the external shell 46 provide access to the wall cavities 54. Through these cleaning openings 58, it is easy to introduce from the outside bars, lances or other cleaning devices in order to push the material accumulated in the wall cavities 54 back onto the sole 22 or even to clean the sole over a certain radial depth which depends on the tools employed. With tools with their tips bent back through a certain angle, it is also possible through the cleaning openings 58 to clean the inner surface 42 of the refractory liner around an access opening 56.

For reasons of stability, leak-tightness and thermal insulation of the furnace wall 10, the cleaning opening associated with a wall cavity 54 will be substantially smaller in cross section than the access opening 56 formed by this wall cavity in the scraped zone 52. The cross section of the wall cavity 54 thus diminishes gradually in the direction of the cleaning opening. In the preferred embodiment shown in the drawings, the wall cavities 54 are, for example, pyramidal in shape, and the cleaning openings are cylindrical in shape and are formed on the apex axis of the pyramid (see FIGS. 2 and 3). The pyramidal wall cavities 54 will most frequently be rectangular or square in cross section. However, their cross section may also be triangular or polygonal and, in general, be of a shape to fit other objects incorporated into the furnace wall, for example openings for burners, gas ducts, probes, etc. It is also possible to give the wall cavities the shape of an axisymmetric cone and then to make the cleaning opening 58 on the apex axis of this axisymmetric cone.

In FIG. 2, it can be seen that the circumferential extent of the residual surface 60 between two successive access openings $\mathbf{56}_1$, $\mathbf{56}_2$ in the scraped zone 52 is much smaller than the circumferential extent of such an access opening 56. In the example in FIG. 2, the circumferential extent of the residual surface 60 between two successive access openings $\mathbf{56}_1$, $\mathbf{56}_2$ in the scraped zone 52 only represents, for example, 20% of the circumferential extent of an access opening 56. The smaller the circumferential extent of the residual surface 60, the lower the risk of forming of a peripheral crust adhering to the inner surface 42 of the furnace wall 10. In an extreme case, two successive access openings $\mathbf{56}_1$, $\mathbf{56}_2$ in the scraped zone 52 may even be separated by a sharp edge, so that in the scraped zone 52 there is practically no surface left on which a hardened crust of material could form. Moreover, in the vertical direction, the access openings 56 extend slightly beyond the upper circumference delimiting the scraped zone 52.

Figure 4:
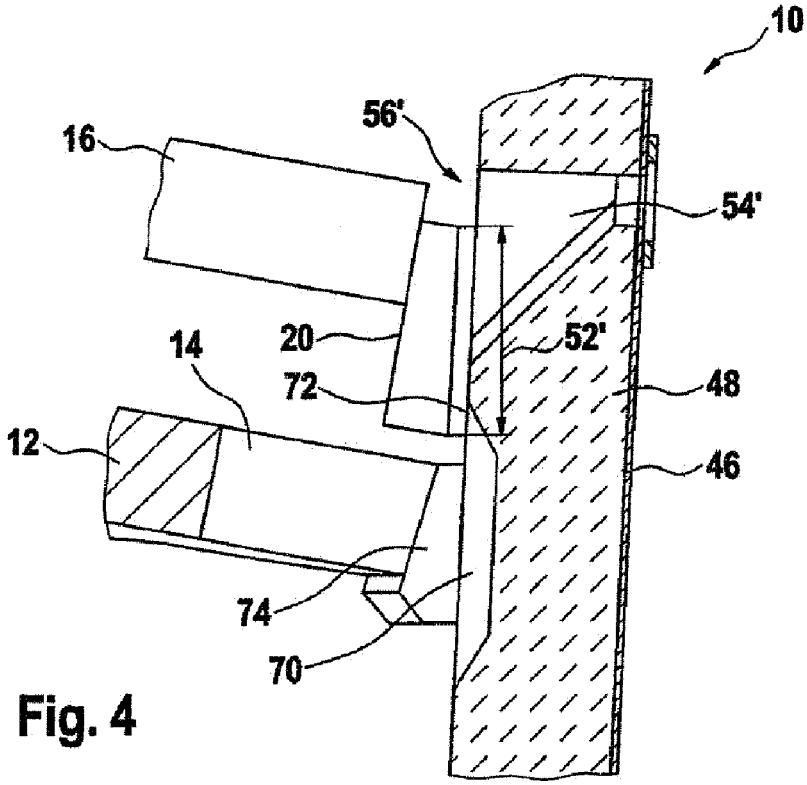
FIG. 4: A vertical cross section along the line 4-4" shown in FIG. 1.

FIG. 4 shows a vertical cross section through the furnace wall 10 at the level of the sole 12 in FIG. 1. The reference 52' indicates the extent of the "scraped zone" of the furnace wall 10 at the level of this sole 12. As in the case of the scraped zone 52 at the level of the sole 22, the scraped zone 52' is also subdivided by a succession of access openings 56' formed by wall cavities 54' in the refractory liner 48. The only significant difference is that at the level of the peripheral drop holes 14 in this sole 12, there is a wall depression 70 in the refractory liner 48, the purpose of which is to enlarge the cross section of a peripheral drop hole 14. Since this wall depression 70 in the furnace wall extends a little way beyond the lower circumference delimiting the scraped zone 52', the access opening 56' does not extend as far as the lower circumference delimiting the scraped zone 52', but stops above the upper edge 72 of the depression 70.

Figure 5:
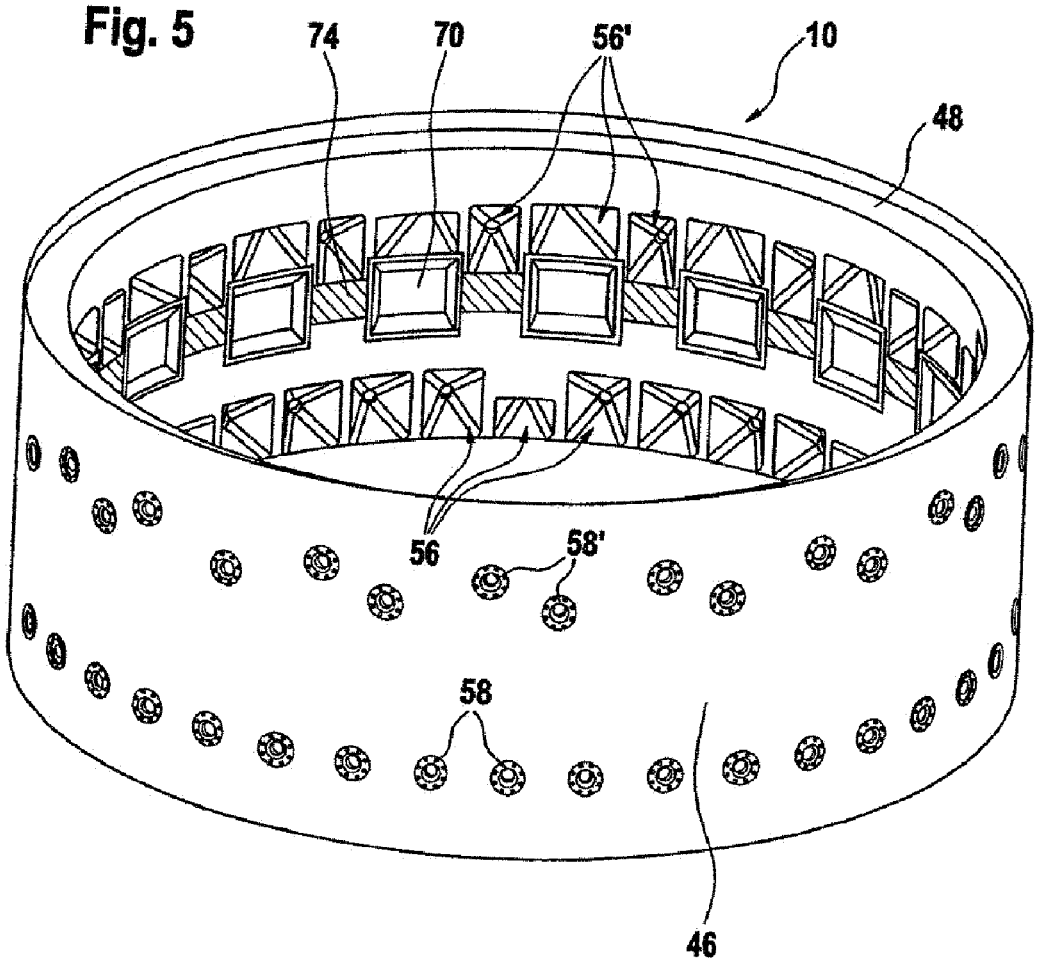
FIG. 5: A three-dimensional view of an annular element of a furnace wall of a multiple-hearth furnace according to the invention.

The way in which the access openings 56, 56' are arranged in the inner surface of the refractory liner will be better understood by reference to FIG. 5, which shows a three-dimensional view of an annular element of the furnace wall 10. No soles are shown in FIG. 5. The hatched rectangles 74 indicate the positions of support blocks for a sole of the type in FIG. 1, that is to say a sole with peripheral discharge holes 14. The wall depressions 70 between the support blocks 74 are plainly visible. In the assembled multiple-hearth furnace, a sole with a central discharge opening will be arranged immediately below the lower edge of the annular element depicted. The upper row of access openings 56' is then the succession of access openings associated with a sole 12 with peripheral discharge holes 14, while the lower row of access openings 56 is the succession of access openings associated with a sole 22 with central discharge opening 24. On the side where the external shell 46 is visible, the cleaning openings 58' giving access to the wall cavities 54' and the cleaning openings 58 giving access to the wall cavities 54 can be seen.

Figure 6:
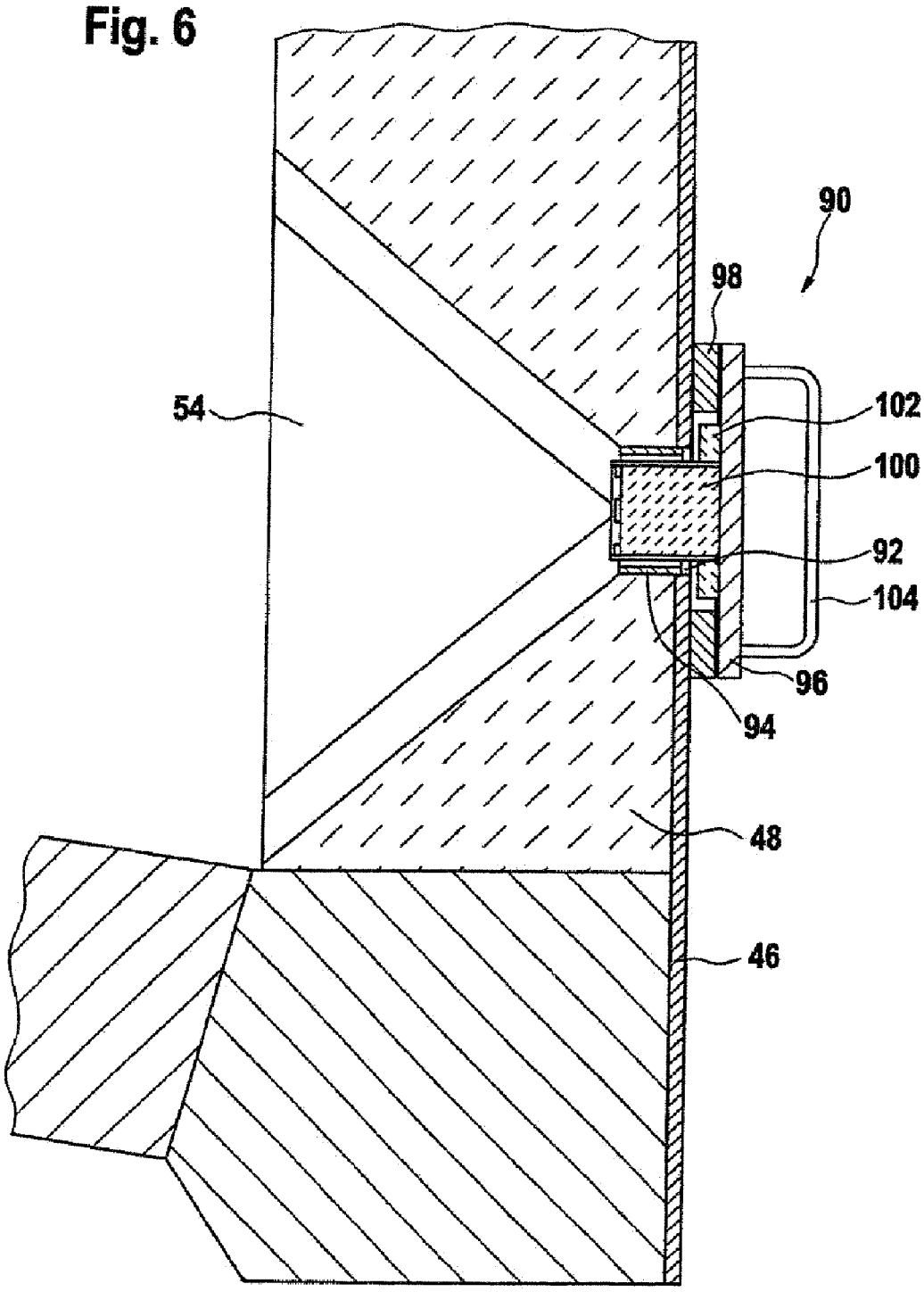
FIG. 6: A vertical cross section through the furnace wall at the level of a wall cavity with a cleaning opening equipped with a plugging device.

FIG. 6 shows, in a vertical cross section, a detail of a wall cavity 54 with a cleaning opening hermetically sealed by means of a leak-proof plugging device 90. The cleaning opening proper comprises a hole 92 in the external shell 46. This hole 92 opens into a metal sleeve 94 which extends a certain distance into the refractory liner 48. The leak-proof plugging device 90 comprises a steel blind flange 96 fixed to a companion flange 98 of the external shell 46, and a central core 100 made of refractory material that penetrates into the metal sleeve 94. A refractory ring 102 surrounds the central core 100. The blind flange 96 is fixed onto the companion flange 98 by means of keys mounted on pivots, so that the blind flange 96 can be removed and refitted quickly. A hand-grip 104 is provided for easy handling of the leak-proof plugging device 90.

The invention claimed is:

1. A multiple-hearth furnace comprising:

a furnace wall delimiting a cylindrical space with a vertical axis, said furnace wall comprising an inner surface and an outer surface;

a plurality of soles delimiting said hearths within said cylindrical space;

at least one rabble arm with a wall scraper configured to recover material that accumulates in the vicinity of the furnace wall, said rabble arm being associated with one of said soles, where it is able to rotate about said vertical axis, and said wall scraper defining, during rotation of said rabble arm, an annular scraped zone on said inner surface of said furnace wall;

wherein said furnace wall comprises a plurality of wall cavities which form a succession of access openings in said scraped zone, said wall cavities being configured so that they progressively fill with material through said access opening during rotation of said rabble arm.

2. The multiple-hearth furnace as claimed in claim 1, wherein said furnace wall comprises an external shell and a refractory inner liner, said wall cavities being arranged in said refractory inner liner and said shell being equipped with cleaning openings through which the wall cavities are accessible.

3. The multiple-hearth furnace as claimed in claim 2, wherein the cleaning opening associated with a wall cavity is substantially smaller in cross section than the access opening formed by said wall cavity in said scraped zone.

4. The multiple-hearth furnace as claimed in claim 3, wherein the cross section of said wall cavity diminishes progressively in the direction towards the cleaning opening.

5. The multiple-hearth furnace as claimed in claim 4, wherein the circumferential extent of a residual surface between two successive access openings in said scraped zone is smaller than the circumferential extent of an access opening.

6. The multiple-hearth furnace as claimed in claim 5, wherein the circumferential extent of the residual surface between two successive access openings in said scraped zone is smaller than 50% of the circumferential extent of an access opening.

7. The multiple-hearth furnace as claimed in claim 1, wherein said access openings in said scraped zone extend in a vertical direction slightly beyond the upper limit of said scraped zone.

8. The multiple-hearth furnace as claimed in claim 6, wherein said access openings in said scraped zone extend in a vertical direction slightly beyond the upper limit of said scraped zone.

9. The multiple-hearth furnace as claimed in claim 1, wherein two successive access openings in said scraped zone are separated by a sharp edge.

10. The multiple-hearth furnace as claimed in claim 6, wherein two successive access openings in said scraped zone are separated by a sharp edge.

11. The multiple-hearth furnace as claimed in claim 1, further comprising a plugging device associated with each of said cleaning openings.

12. The multiple-hearth furnace as claimed in claim 6, further comprising a plugging device associated with each of said cleaning openings.

13. The multiple-hearth furnace as claimed in claim 12, wherein said plugging device further comprises:

a steel blind flange fixed to a companion flange of the external shell; and a central core made of refractory material that penetrates into the cleaning opening.

14. A multiple-hearth furnace comprising:

a furnace wall delimiting a cylindrical space with a vertical axis, said furnace wall comprising an inner surface and an outer surface;

a plurality of soles delimiting said hearths within said cylindrical space;

at least one rabble arm with a wall scraper, said rabble arm being associated with one of said soles, where it is able to rotate about said vertical axis to displace material under treatment on said associated sole, and said wall scraper defining, during rotation of said rabble arm, an annular scraped zone on said inner surface of said furnace wall and being configured to recover material under treatment that accumulates in the vicinity of said furnace wall;

wherein said furnace wall comprises a plurality of wall cavities which form a succession of access openings in said scraped zone, the circumferential extent of a residual surface between two successive access openings in said scraped zone being smaller than the circumferential extent of an access opening, each wall cavity allowing material under treatment to accumulate in said wall cavity.

15. The multiple-hearth furnace as claimed in claim 14, wherein said furnace wall comprises an external shell and a refractory inner liner, said wall cavities being arranged in said refractory inner liner and said shell being equipped with cleaning openings through which the wall cavities are accessible.

16. The multiple-hearth furnace as claimed in claim 15, wherein the cross section of said wall cavity diminishes progressively in the direction towards its associated cleaning opening.

17. A multiple-hearth furnace comprising:

a furnace wall delimiting a cylindrical space with a vertical axis, said furnace wall comprising an inner surface and an outer surface;

a plurality of soles delimiting said hearths within said cylindrical space;

at least one rabble arm with a wall scraper, said rabble arm being associated with one of said soles, where it is able to rotate about said vertical axis, and said wall scraper defining, during rotation of said rabble arm, an annular scraped zone on said inner surface of said furnace wall;

wherein said furnace wall comprises a plurality of wall cavities, which form a succession of access openings in said scraped zone, and each wall cavity is configured so that it progressively fills with material during rotation of said rabble arm; and has an associated cleaning opening that is substantially smaller in cross section than the access opening formed by said wall cavity and through which said wall cavity is accessible from outside said furnace wall in order to allow pushing material accumulated in said wall cavity back onto the sole associated to said rabble arm.

18. The multiple-hearth furnace as claimed in claim 17, wherein the cross section of each wall cavity diminishes progressively in the direction towards its associated cleaning opening.

19. The multiple-hearth furnace as claimed in claim 17, wherein each cleaning opening has an associated a leak-proof plugging device.

20. The multiple-hearth furnace as claimed in claim 17, wherein each cleaning opening has a height substantially smaller than the height of said scraped zone.

* * * * *